US006204743B1

(12) United States Patent
Greenberg et al.

(10) Patent No.: US 6,204,743 B1
(45) Date of Patent: Mar. 20, 2001

(54) DUAL CONNECTOR STRAP FOR A ROTARY CONTACT CIRCUIT BREAKER

(75) Inventors: Randy Greenberg, Granby; Dean A. Robarge, Southington; Dennis J. Doughty, Plainville; Ranganna C. Dasari, Bristol, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/515,202

(22) Filed: Feb. 29, 2000

(51) Int. Cl.[7] ..... H01H 9/00

(52) U.S. Cl. ..... 335/172; 335/18; 335/16; 218/22

(58) Field of Search ..... 218/22, 33; 361/42–51; 335/16, 147, 195, 18

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamat . |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |

(List continued on next page.)

*Primary Examiner*—Lincoln Donovan
(74) *Attorney, Agent, or Firm*—Cantor Colburn LLP; Carl B. Horton

(57) ABSTRACT

An electrically conducting strap for use in a rotary circuit breaker cassette provides dual connectors to accommodate either an electronic or mechanical trip unit within the circuit breaker and electrical distribution system. The continuous, integral strap includes a first section including a fixed contact mounted thereon, a U-shaped second section, a third section having two apertures for connection to associated electrical equipment, and a fourth section having two apertures for connection to a line of a distribution system providing electrical power to a load. Thus, the circuit breaker has the advantage of reduced cost and increased ease of manufacturability since a common cassette is used.

12 Claims, 4 Drawing Sheets

U.S. PATENT DOCUMENTS

| | | | | |
|---|---|---|---|---|
| 4,263,492 | | 4/1981 | Maier et al. . | |
| 4,276,527 | | 6/1981 | Gerbert-Gaillard et al. . | |
| 4,297,663 | | 10/1981 | Seymour et al. . | |
| 4,301,342 | | 11/1981 | Castonguay et al. . | |
| 4,360,852 | | 11/1982 | Gilmore . | |
| 4,368,444 | | 1/1983 | Preuss et al. . | |
| 4,375,021 | | 2/1983 | Pardini et al. . | |
| 4,375,022 | | 2/1983 | Daussin et al. . | |
| 4,376,270 | | 3/1983 | Staffen . | |
| 4,383,146 | | 5/1983 | Bur . | |
| 4,392,036 | | 7/1983 | Troebel et al. . | |
| 4,393,283 | | 7/1983 | Masuda . | |
| 4,401,872 | | 8/1983 | Boichot-Castagne et al. . | |
| 4,409,573 | | 10/1983 | DiMarco et al. . | |
| 4,435,690 | | 3/1984 | Link et al. . | |
| 4,467,297 | | 8/1984 | Boichot-Castagne et al. . | |
| 4,468,645 | | 8/1984 | Gerbert-Gaillard et al. . | |
| 4,470,027 | | 9/1984 | Link et al. . | |
| 4,479,143 | | 10/1984 | Watanabe et al. . | |
| 4,488,133 | | 12/1984 | McClellan et al. . | |
| 4,492,941 | | 1/1985 | Nagel . | |
| 4,541,032 | | 9/1985 | Schwab . | |
| 4,546,224 | | 10/1985 | Mostosi . | |
| 4,550,360 | | 10/1985 | Dougherty . | |
| 4,562,419 | | 12/1985 | Preuss et al. . | |
| 4,589,052 | | 5/1986 | Dougherty . | |
| 4,595,812 | | 6/1986 | Tamaru et al. . | |
| 4,611,187 | | 9/1986 | Banfi . | |
| 4,612,430 | | 9/1986 | Sloan et al. . | |
| 4,616,198 | | 10/1986 | Pardini . | |
| 4,622,444 | | 11/1986 | Kandatsu et al. . | |
| 4,631,625 | | 12/1986 | Alexander et al. . | |
| 4,642,431 | | 2/1987 | Tedesco et al. . | |
| 4,644,438 | | 2/1987 | Puccinelli et al. . | |
| 4,649,247 | | 3/1987 | Preuss et al. . | |
| 4,658,322 | | 4/1987 | Rivera . | |
| 4,672,501 | | 6/1987 | Bilac et al. . | |
| 4,675,481 | | 6/1987 | Markowski et al. . | |
| 4,682,264 | | 7/1987 | Demeyer . | |
| 4,689,712 | | 8/1987 | Demeyer . | |
| 4,694,373 | | 9/1987 | Demeyer . | |
| 4,710,845 | | 12/1987 | Demeyer . | |
| 4,717,985 | | 1/1988 | Demeyer . | |
| 4,733,211 | | 3/1988 | Castonguay et al. . | |
| 4,733,321 | | 3/1988 | Lindeperg . | |
| 4,764,650 | | 8/1988 | Bur et al. . | |
| 4,768,007 | | 8/1988 | Mertz et al. . | |
| 4,780,786 | | 10/1988 | Weynachter et al. . | |
| 4,831,221 | | 5/1989 | Yu et al. . | |
| 4,870,531 | | 9/1989 | Danek . | |
| 4,883,931 | | 11/1989 | Batteux et al. . | |
| 4,884,047 | | 11/1989 | Baginski et al. . | |
| 4,884,164 | | 11/1989 | Dziura et al. . | |
| 4,900,882 | | 2/1990 | Bernard et al. . | |
| 4,910,485 | | 3/1990 | Bolongeat-Mobleu et al. . | |
| 4,914,541 | | 4/1990 | Tripodi et al. . | |
| 4,916,419 | * | 4/1990 | Winter | 335/16 |
| 4,916,420 | | 4/1990 | Bartolo et al. . | |
| 4,916,421 | | 4/1990 | Pardini et al. . | |
| 4,926,282 | | 5/1990 | McGhie . | |
| 4,935,590 | | 6/1990 | Malkin et al. . | |
| 4,937,706 | | 6/1990 | Schueller et al. . | |
| 4,939,492 | | 7/1990 | Raso et al. . | |
| 4,943,691 | | 7/1990 | Mertz et al. . | |
| 4,943,888 | | 7/1990 | Jacob et al. . | |
| 4,950,855 | | 8/1990 | Bolonegeat-Mobleu et al. . | |
| 4,951,019 | | 8/1990 | Gula . | |
| 4,952,897 | | 8/1990 | Barnel et al. . | |
| 4,958,135 | | 9/1990 | Baginski et al. . | |
| 4,965,543 | | 10/1990 | Batteux . | |
| 4,983,788 | | 1/1991 | Pardini . | |
| 5,001,313 | | 3/1991 | Leclerq et al. . | |
| 5,004,878 | | 4/1991 | Seymour et al. . | |
| 5,029,301 | | 7/1991 | Nebon et al. . | |
| 5,030,804 | | 7/1991 | Abri . | |
| 5,057,655 | | 10/1991 | Kersusan et al. . | |
| 5,077,627 | | 12/1991 | Fraisse . | |
| 5,083,081 | | 1/1992 | Barrault et al. . | |
| 5,095,183 | | 3/1992 | Raphard et al. . | |
| 5,103,198 | | 4/1992 | Morel et al. . | |
| 5,115,371 | | 5/1992 | Tripodi . | |
| 5,120,921 | | 6/1992 | DiMarco et al. . | |
| 5,132,865 | | 7/1992 | Mertz et al. . | |
| 5,138,121 | | 8/1992 | Streich et al. . | |
| 5,140,115 | | 8/1992 | Morris . | |
| 5,153,802 | | 10/1992 | Mertz et al. . | |
| 5,155,315 | | 10/1992 | Malkin et al. . | |
| 5,166,483 | | 11/1992 | Kersusan et al. . | |
| 5,172,087 | | 12/1992 | Castonguay et al. . | |
| 5,178,504 | | 1/1993 | Falchi . | |
| 5,184,717 | | 2/1993 | Chou et al. . | |
| 5,187,339 | | 2/1993 | Lissandrin . | |
| 5,198,956 | | 3/1993 | Dvorak . | |
| 5,200,724 | | 4/1993 | Gula et al. . | |
| 5,210,385 | | 5/1993 | Morel et al. . | |
| 5,239,150 | | 8/1993 | Bolongeat-Mobleu et al. . | |
| 5,260,533 | | 11/1993 | Livesey et al. . | |
| 5,262,744 | | 11/1993 | Arnold et al. . | |
| 5,268,661 | * | 12/1993 | Grunert et al. | 335/16 |
| 5,280,144 | | 1/1994 | Bolongeat-Mobleu et al. . | |
| 5,281,776 | | 1/1994 | Morel et al. . | |
| 5,296,660 | | 3/1994 | Morel et al. . | |
| 5,296,664 | | 3/1994 | Crookston et al. . | |
| 5,298,874 | | 3/1994 | Morel et al. . | |
| 5,300,907 | | 4/1994 | Nereau et al. . | |
| 5,310,971 | | 5/1994 | Vial et al. . | |
| 5,313,180 | * | 5/1994 | Vial et al. | 335/16 |
| 5,317,471 | | 5/1994 | Izoard et al. . | |
| 5,331,500 | | 7/1994 | Corcoles et al. . | |
| 5,334,808 | | 8/1994 | Bur et al. . | |
| 5,341,191 | | 8/1994 | Crookston et al. . | |
| 5,347,096 | | 9/1994 | Bolongeat-Mobleu et al. . | |
| 5,347,097 | | 9/1994 | Bolongeat-Mobleu et al. . | |
| 5,350,892 | | 9/1994 | Rozier . | |
| 5,357,066 | | 10/1994 | Morel et al. . | |
| 5,357,068 | | 10/1994 | Rozier . | |
| 5,357,394 | | 10/1994 | Piney . | |
| 5,361,052 | | 11/1994 | Ferullo et al. . | |
| 5,373,130 | | 12/1994 | Barrault et al. . | |
| 5,373,272 | * | 12/1994 | Scheel et al. | 335/16 |
| 5,379,013 | | 1/1995 | Coudert . | |
| 5,424,701 | | 6/1995 | Castonguary et al. . | |
| 5,438,176 | | 8/1995 | Bonnardel et al. . | |
| 5,440,088 | | 8/1995 | Coudert et al. . | |
| 5,449,871 | | 9/1995 | Batteux et al. . | |
| 5,450,048 | | 9/1995 | Leger et al . | |
| 5,451,729 | | 9/1995 | Onderka et al. . | |
| 5,457,295 | | 10/1995 | Tanibe et al. . | |
| 5,467,069 | | 11/1995 | Payet-Burin et al. . | |
| 5,469,121 | | 11/1995 | Payet-Burin . | |
| 5,475,558 | | 12/1995 | Barjonnet et al. . | |
| 5,477,016 | | 12/1995 | Baginski et al. . | |
| 5,479,143 | * | 12/1995 | Payet-Burin | 335/202 |
| 5,483,212 | | 1/1996 | Lankuttis et al. . | |
| 5,485,343 | | 1/1996 | Santos et al. . | |
| 5,493,083 | | 2/1996 | Olivier . | |
| 5,504,284 | | 4/1996 | Lazareth et al. . | |
| 5,504,290 | | 4/1996 | Baginski et al. . | |
| 5,510,761 | | 4/1996 | Boder et al. . | |
| 5,512,720 | | 4/1996 | Coudert et al. . | |
| 5,515,018 | | 5/1996 | DiMarco et al. . | |

| | | |
|---|---|---|
| 5,519,561 | 5/1996 | Mrenna et al. . |
| 5,534,674 | 7/1996 | Steffens . |
| 5,534,832 | 7/1996 | Duchemin et al. . |
| 5,534,835 | 7/1996 | McColloch et al. . |
| 5,534,840 | 7/1996 | Cuingnet . |
| 5,539,168 | 7/1996 | Linzenich . |
| 5,543,595 | 8/1996 | Mader et al. . |
| 5,552,755 | 9/1996 | Fello et al. . |
| 5,581,219 | 12/1996 | Nozawa et al. . |
| 5,604,656 | 2/1997 | Derrick et al. . |
| 5,608,367 | 3/1997 | Zoller et al. . |
| 5,784,233 | 7/1998 | Bastard et al. . |

FOREIGN PATENT DOCUMENTS

| | | |
|---|---|---|
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

DUAL CONNECTOR STRAP FOR A ROTARY CONTACT CIRCUIT BREAKER

BACKGROUND OF THE INVENTION

The present invention relates generally to circuit breakers and more particularly, an electrically conductive dual connector strap for connection of either an electronic trip unit or a mechanical trip unit (e.g. thermal magnetic or magnetic).

Circuit breakers are one of a variety of overcurrent protective devices used for circuit breaker protection and isolation. The basic function of a circuit breaker is to provide electrical system protection whenever an electrical abnormality occurs in any part of the system. In a rotary contact circuit breaker, current enters the system from a power line. The current passes through a load strap to a stationary contact fixed on the strap and then to a moveable contact. The moveable contact is fixedly attached to an arm, and the arm is mounted to a rotor that in turn is rotatably mounted in a cassette. As long as the fixed contact is in physical contact with the moveable contact, the current passes from the fixed contact to the moveable contact and out of the circuit breaker to down line electrical devices.

In the event of an extremely high overcurrent condition (e.g. a short circuit), electromagnetic forces are generated between the fixed and moveable contacts. These electromagnetic forces repel the movable contact away from the fixed contact. Because the moveable contact is fixedly attached to a rotating arm, the arm pivots and physically separates the fixed contact from the moveable contact, thus tripping the unit.

Protection against persistent and instantaneous overcurrent conditions is provided in many circuit breakers by a thermal-magnetic trip unit having a thermal trip portion, which trips the circuit breaker on persistent overcurrent conditions, and a magnetic trip portion, which trips the circuit breaker on short-circuit conditions.

In order to trip the circuit breaker, the thermal-magnetic trip unit activates an operating mechanism. Once activated, the operating mechanism separates the fixed and moveable contacts to stop the flow of current in the protected circuit. Conventional trip units act directly upon the operating mechanism to activate the operating mechanism. In a mechanical thermal-magnetic trip unit, a bimetal element is connected with the associated electric circuit for persistent overcurrent detection. If a long-term overcurrent condition causes the bimetal to reach a predetermined temperature, the bimetal bends and unlatches the operating mechanism to trip the circuit breaker. A magnetic trip unit is employed for instantaneous overcurrent detection. In other words, the magnetic element interrupts the circuit when a high level of overcurrent persists for a short, predetermined period of time. Modern magnetic trip units include a magnet yoke (anvil) disposed about a current carrying strap, an armature (lever) pivotally disposed proximate the anvil, and a spring arranged to bias the armature away from the magnet yoke. Upon the occurrence of a short circuit condition, very high currents pass through the strap. The increased current causes an increase in the magnetic field about the magnet yoke. The magnetic field acts to rapidly draw the armature towards the magnet yoke, against the bias of the spring. As the armature moves towards the yoke, the end of the armature contacts a trip lever, which is mechanically linked to the circuit breaker operating mechanism. Movement of the trip lever trips the operating mechanism, causing the fixed and moveable contacts to open and stop the flow of electrical current to a protected circuit.

Some circuit breakers employ an electronic trip unit to provide persistent and/or instantaneous overcurrent detection. Electronic trip units are well known. Electronic trip units typically are comprised of current sensors that provide analog signals indicative of the power line signals. The analog signals are converted by an A/D (analog/digital) converter to digital signals which are processed by a microcontroller. The trip unit further includes RAM (random access memory), ROM (read only memory) and EEPROM (electronic erasable programmable read only memory) all of which interface with the microcontroller. The ROM includes trip unit application code, e.g., main functionality firmware, including initializing parameters, and boot code. The EEPROM includes operational parameters for the application code. When the signal received by the electronic trip unit indicates an overcurrent condition, an output of the electronic trip unit actuates an electromechanical actuator, which in turn, unlatches the operating mechanism to trip the circuit breaker. Conventional circuit breaker devices with electronic trip units utilize a current transformer disposed around one of the current carrying straps within the circuit breaker. The current transformer performs two functions. First, it provides operating power to the trip unit circuitry.

For a given model of circuit breaker, various types of trip units may be used. For example, mounted within a circuit breaker housing, a mechanical trip unit (e.g. thermal-magnetic or magnetic) can be employed. Alternatively, an electronic trip unit can also be employed that utilizes a current transformer. In order to accommodate the various trip units that can be selected within an electrical distribution system, different types of mechanical connections to conductors (straps) are required based on the type of trip unit employed. Further, in order to simplify manufacturing, it is desired to have the ability for late point identification of the type of trip unit to be employed.

SUMMARY OF INVENTION

In an exemplary embodiment of the present invention, an electrically conductive dual connector strap for use in a rotary circuit breaker cassette provides apertures to accommodate either a mechanical or an electronic trip unit utilized with a circuit breaker and electrical distribution system. The continuous, integral strap includes a first section including a fixed contact mounted thereon, a U-shaped second section, a third section having two apertures for connection to a mechanical trip unit, and a fourth section having two apertures for connection to a load line of a distribution system providing electrical power to a load.

DESCRIPTION OF THE PREFERRED EMBODIMENT

Figure 1:
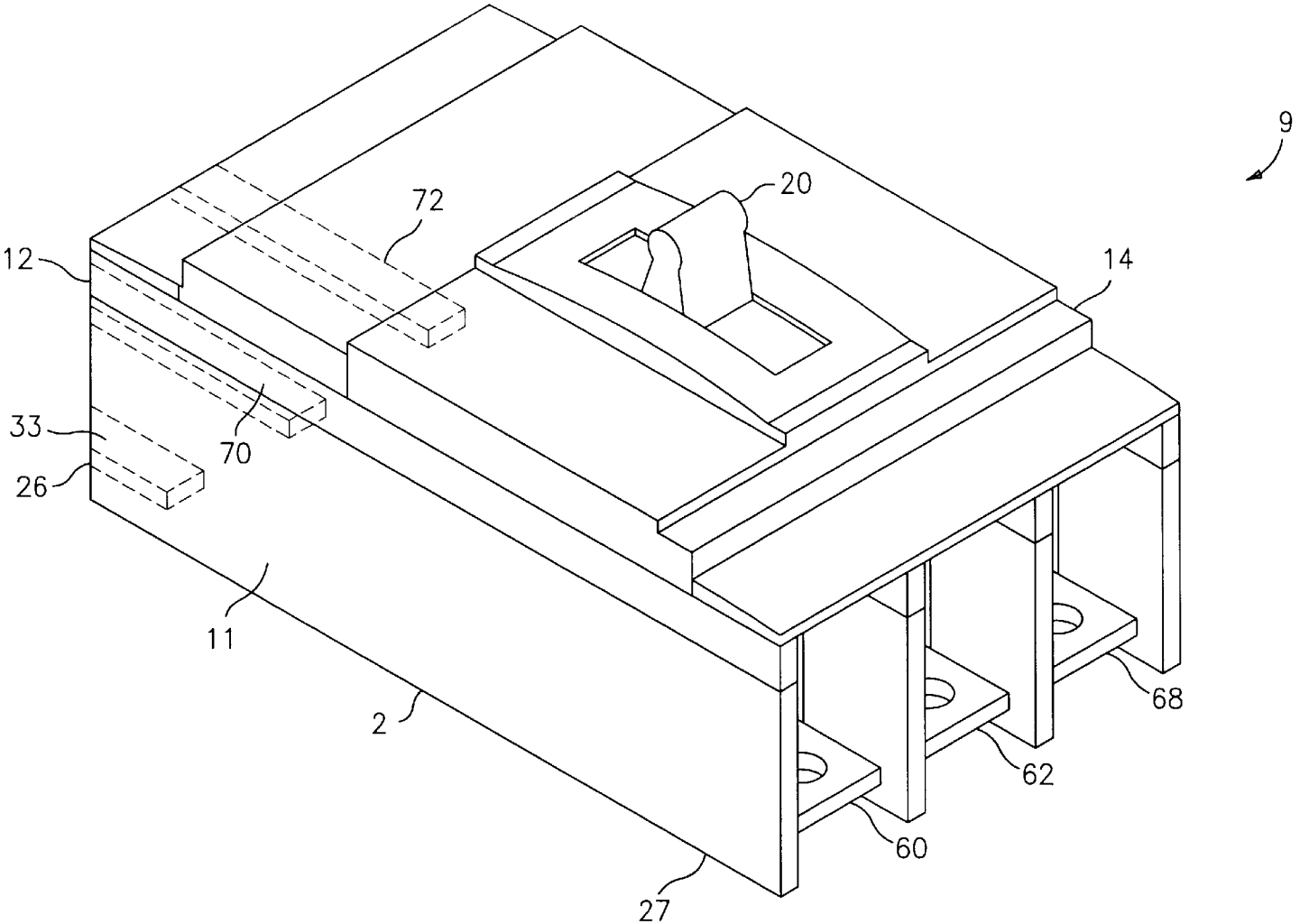
FIG. 1 is a perspective view of a circuit breaker.

Referring to FIG. 1, an embodiment of a molded case circuit breaker 9 is generally shown. Circuit breakers of this type have an insulated case 11 and a mid-cover 12 that house the components of the circuit breaker 9. A handle 20 extending through a cover 14 gives the operator the ability to turn the circuit breaker 9 "on" to energize a protected circuit (shown in dashed lines FIG. 3), turn the circuit breaker "off" to disconnect the protected circuit (shown in solid lines FIG. 3), or "reset" the circuit breaker after a fault (not shown). When the circuit breaker is "on", a first and second fixed electrical contacts 36, 38 (FIG. 3) are closed with respect to a first and second moveable electrical contacts 37, 39 (FIG. 3) thereby maintaining current flow through the circuit breaker 9. First moveable electrical contact 37 and first fixed electrical contact 36 form a pair of electrical contacts. Second moveable electrical contact 39 and second fixed electrical contact 38 form a pair of electrical contacts. A plurality of electrically conducting line-side contact straps 60, 62, 68 and load straps 33, 70, 72 extend within case 11 for connecting the line and load conductors of the protected circuit. Various trip units are employed on load side 26 of the circuit breaker 9 as opposed to line side 27. The circuit breaker 9 in FIG. 1 shows a typical three-phase configuration, however, the present invention is not limited to this configuration but may be applied to other configurations, such as one, two or four phase circuit breakers.

Figure 2:
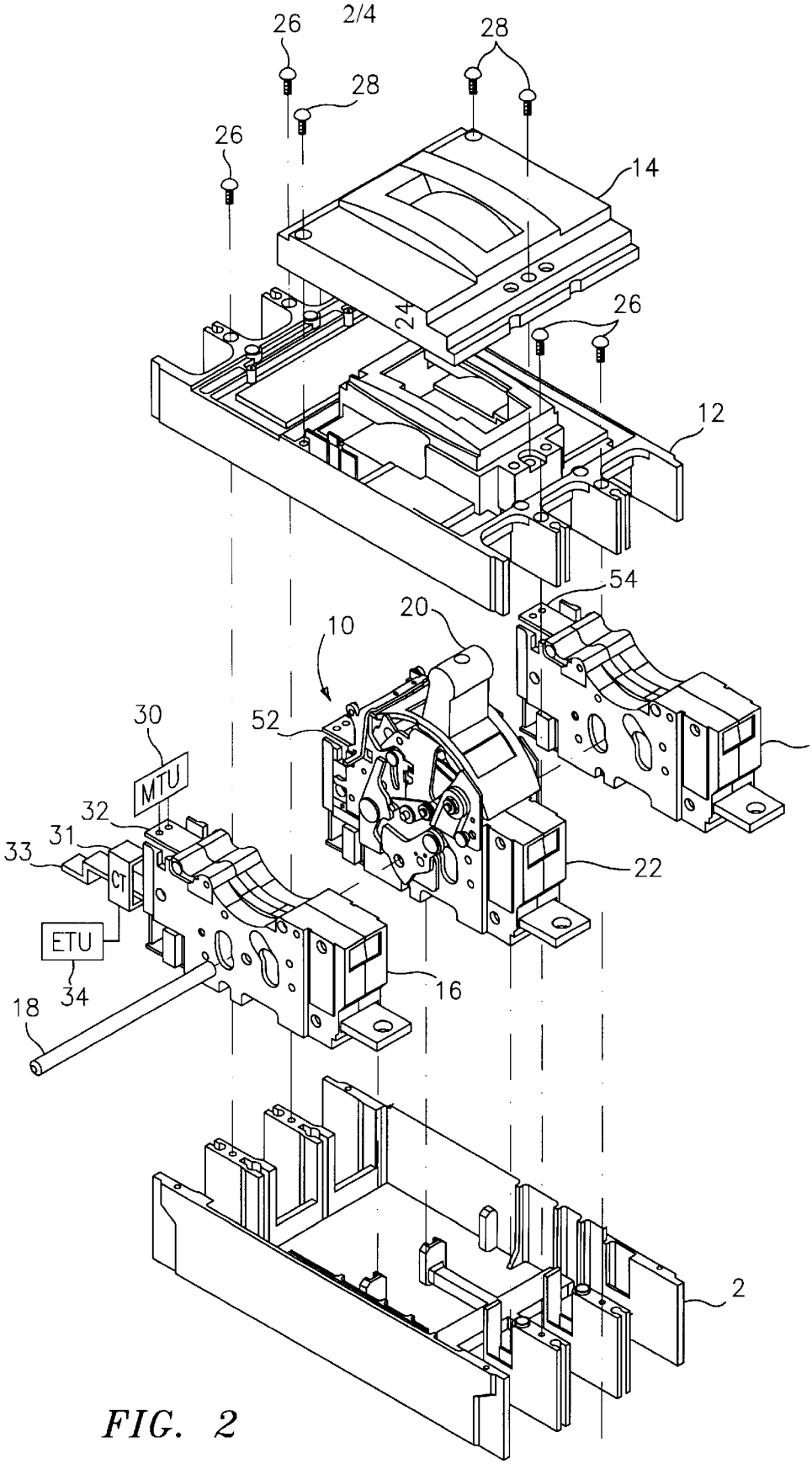
FIG. 2 is an exploded view of the circuit breaker of FIG. 1.

Referring to FIG. 2, the handle 20 is attached to a circuit breaker operating mechanism 10. The circuit breaker operating mechanism 10 is coupled with an electrically insulative center cassette (cassette) 22 and is connected with electrically insulative outer cassette (cassette) 16 and electrically insulative cassette (cassette) 24 by a drive pin 18. The cassettes 16, 22, 24 along with the circuit breaker operating mechanism 10 are assembled into the base 2 and retained therein by the mid-cover 12. The mid-cover 12 is connected to the base by any convenient means, such as screws 6, snap-fit (not shown) or adhesive bonding (not shown). A cover 14 is attached to the mid-cover 12 by screws 28.

Each cassette 16, 22, 24 encloses a continuous load-side contact strap 32, 52, 54 which extend from within the cassette 16, 22, 24 to outside the cassette 16, 22, 24 for connection to load strap 33, 70, 72 (FIG. 1) preferably attaching with screws (not shown) or any other method commonly used in circuit breaker manufacture, such as brazing. Load straps 33, 70, 72 conduct current from the power source to the protected circuit. A mechanical trip unit (MTU) (e.g. thermal and/or magnetic trip unit (ETU)) 30 is attached to contact strap 32. Alternatively, an electronic trip unit 34 can be employed. In this case, disposed around load strap 33 is a current transformer (CT) 31 that provides operating power and inputs current signals to an electronic trip unit 34. Mechanical and electronic trip units are known in the art.

Although, it is not shown, contact straps 52, 54 similarly connect to a corresponding mechanical trip unit 30. Similarly and alternatively, current transformers (not shown) may be disposed around load straps 70, 72 thereby providing operating power and current signal input to electronic trip units 34 (not shown).

Figure 3:
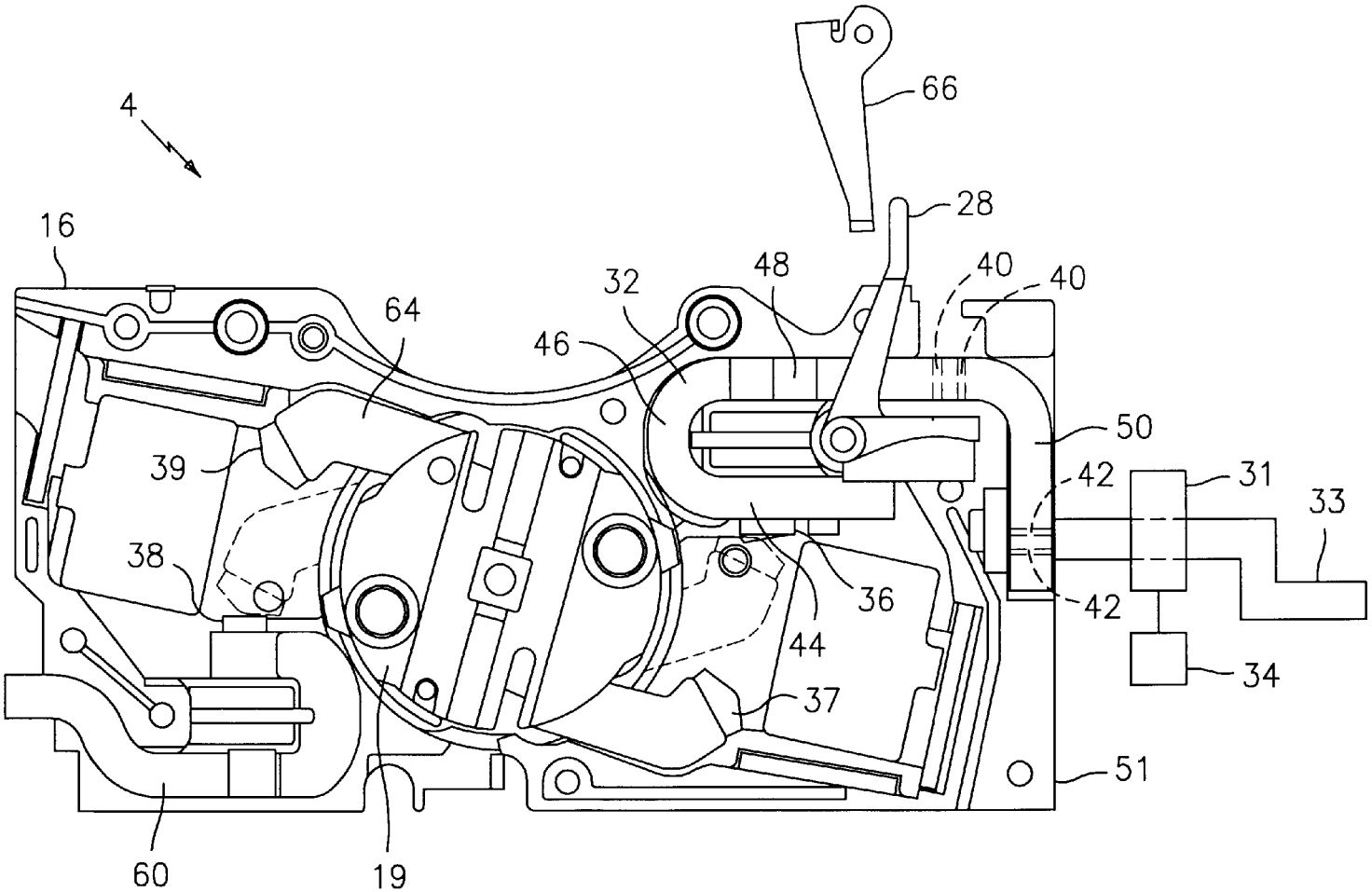
FIG. 3 is a side view of a cassette half piece including the load-side contact strap and dual connectors of the prescnt invention.

Referring to FIG. 3, a circuit breaker rotary contact assembly 4 is shown within one half of an electrically insulative cassette 16. Joining two similar cassette half pieces forms cassette 16. Opposing contact straps 32 and 60 are adapted for connection with an associated electrical distribution system and a protected electric circuit, respectively. Contact strap 60 is located on the line side 27 (FIG. 1); contact strap 32 is located on the load side 26 (FIG. 1). First and second fixed electrical contacts 36, 38 connect with contact straps 32, 60 respectively.

A rotor 19 in the circuit breaker rotary contact assembly 4 is intermediate contact straps 32, 60. A moveable contact arm 64 is arranged between two halves of a circular rotor 19. The moveable contact arm 64 includes first and second moveable electrical contacts 37, 39 that are arranged opposite first and second fixed electrical contacts 36, 38 to complete the circuit connection with contact straps 32, 60. The moveable contact arm 64 moves in unison with the rotor 19 that, in turn, connects with the circuit breaker operating mechanism 10 (FIG. 2) by means of an elongated pin (not shown) and linkage assembly (not shown) to move first and second movable electrical contacts 37, 39 between the CLOSED position, depicted in dashed lines, and the OPEN position depicted in solid lines. Upon a short circuit overcurrent condition, the first and second moveable electrical contacts 37, 39 are separated from the first and second fixed electrical contacts 36, 38 by the operating mechanism 10 (FIG. 2).

A latch 66 is mounted such that it pivots on an axis positioned in the circuit breaker operating mechanism 10 (FIG. 2). The constriction and operation of the circuit breaker operating mechanism 10 (FIG. 2) is known in the art. A trip lever 28 is located proximate to the latch 66. Upon a high-level short circuit condition, trip lever 28 makes contact with latch 66. Latch 66 activates the circuit breaker operating mechanism 10 (FIG. 2) that causes first and second moveable electrical contacts 37, 39 to separate from first and second fixed electrical contacts 36, 38.

Contact strap 32 is shown positioned within the interior of cassette 16. Contact strap 32 has a first section 44, a second section 46, a third section 48 and a fourth section 50. All sections 44, 46, 48, 50 are integral and continuous. First section 44 is located within the cassette 16. Fixed electrical contact 36 is attached to first section 44 proximate to moveable electrical contact 37. Second section 46 is U-shaped and is located within the cassette. Third section 48 is located within the cassette 16 and is parallel to first section 44. Third section 48 includes at least one aperture 40, preferably two apertures 40. Apertures 40 are exposed to the exterior of the cassette 16 thereby providing access to apertures 40 in order to attach mechanical trip unit 30 (FIG. 2). Fourth section 50 extends downward along the exterior of cassette side 51 at an angle, preferably about a ninety-degree angle, from third section 48. Fourth section 50 includes at least one aperture 42, preferably two apertures 42. Apertures 42 are exposed to the exterior of the cassette side 51 thereby providing access to apertures 42 in order to attach load strap 33, which extends through the core of the current transformer 31. Thus, first, second, third and fourth sections 44, 46, 48, 50 form a continuous contact strap 32 on the load side 26 of the circuit breaker 9 (FIG. 1) which extends from the interior of the cassette 16 to the exterior of the cassette 16. Contact strap 32 permits employment of either an electronic trip unit 30 or mechanical trip unit 34 (FIG. 2) to the circuit breaker 9 (FIG. 1) and electrical distribution system.

Figure 4:
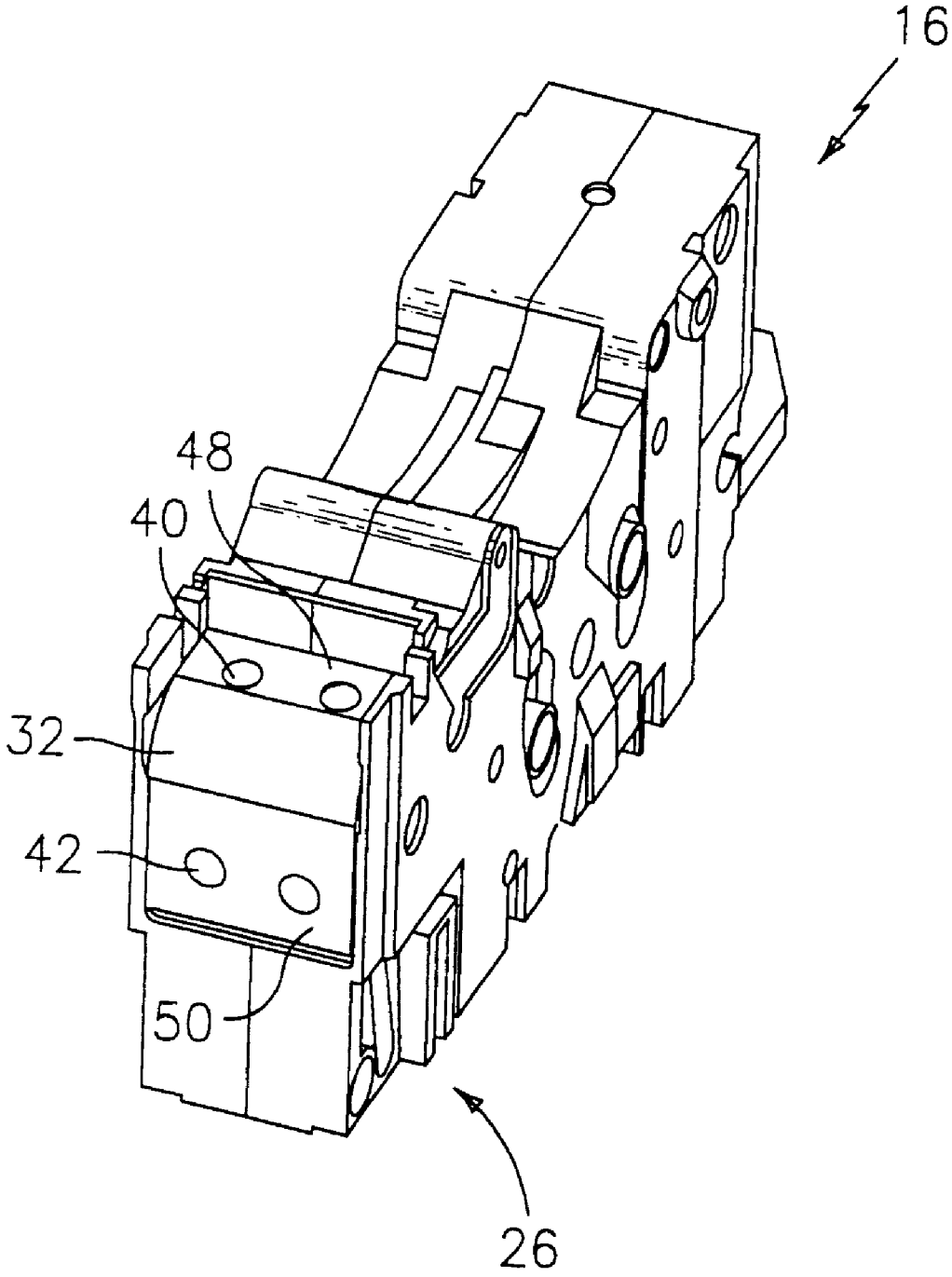
FIG. 4 is an isometric view of the dual connectors of the load-side contact strap.

Referring to FIG. 4, cassette 16 is shown with the contact strap 32 mounted within the cassette 16 on the load side 26. Apertures 40, 42 are shown accessible exterior to the cassette 16. Apertures 40, 42 can be of various sizes to accommodate different electrical connections. Also, contact strap 32 can be of various thickness and cross section to accommodate different ratings of circuit breakers. Contact straps 52, 54 also have apertures (not shown) located on the respective third and fourth sections (not shown). Cassettes 22, 24 are similar to cassette 16. Also arranged within cassettes 22, 24 are contact straps 52, 54 permitting dual connection of the contact straps 52, 54 to either an electronic or mechanical trip unit 34, 30 (FIG. 2).

Referring to FIGS. 1, 2, 3, and 4, if circuit breaker 9 employs a mechanical trip unit 30, apertures 40 are utilized to connect the contact strap 32 with the mechanical trip unit 30. The electrical connection to the load strap 33 is completed by using apertures 42 to connect contact strap 32 with load strap 33 or alternatively, a conductive strap (not shown) of the mechanical trip unit 30 can be used to complete the connection with the load strap 33. If circuit breaker 9 employs an electronic trip unit 34, apertures 42 are utilized to connect the contact strap 32 with the load strap 33. However, when an electronic trip unit 34 is employed, the load strap 33 would extend through the core of the current transformer 31. The secondary winding (not shown) of the current transformer 31 is then connected to the electronic trip unit 34.

In order to accommodate the various trip units that can be selected within an electrical distribution system, different types of mechanical connections to conductors (straps) are required based on the type of trip unit employed. Contact strap 32 is mounted within a cassette 16 and includes provisions to connect either an electronic trip unit 34 or a mechanical trip unit 30 (e.g. thermal-magnetic or magnetic trip unit). Further, in order to simplify manufacturing, it is desired to have the ability for late point selection of the type of trip unit to be employed. In order to accommodate the late selection of various types of trip units, a common circuit breaker frame is required that the selected type of trip unit can fit into. The dual connector contact strap 32, which can employ a mechanical or electronic trip unit 30, 34, permits use of a common cassette 16 within the circuit breaker. Common cassette 16 thereby permits late selection of the type of trip unit to be employed with the circuit breaker 9. Further, circuit breaker 9 has the advantage of reduced cost and increased ease of manufacturability since a common cassette 16 is used.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but rather that the invention will include all embodiments falling within the scope of the appended claims.

What is claimed is:

1. A contact strap arranged for conducting electrical current and suitable for use in a rotary circuit breaker cassette within a circuit breaker housing, said contact strap comprising:

a first section including a fixed contact mounted thereon;

a U-shaped second section continuous with said first section;

a third section continuous with said U-shaped second section, said third section having an aperture, said aperture aligned with a cut-away portion of the cassette and configured to accept connection with a mechanical trip unit external to the cassette; and a fourth section continuous with said third section, said fourth section having an aperture, said aperture of said fourth section is configured to connect with a load strap, the load strap forming the primary winding of a current transformer arranged within the housing, the current transformer electrically connected to an electronic trip unit arranged within the housing.

2. The contact strap of claim 1 wherein said fourth section is angled to said third section.

3. The contact strap of claim 1 wherein said fourth section is perpendicular to said third section.

4. A circuit breaker comprising:

a molded case housing;

a cassette arranged within said molded case housing, said cassette having a cut-away portion;

an electrically conductive contact strap arranged within said cassette, wherein said electrically conductive contact strap includes:

a first section including a fixed contact mounted thereon, a U-shaped second section continuous with said first section, a third section continuous with said U-shaped second section, said third section is arranged proximate to said cut-away portion of said cassette, said third section having an aperture for connection to electrical equipment external to said cassette, and a fourth section continuous with said third section, said fourth section having an aperture, wherein said aperture in said fourth section is configured to connect with a load strap, the load strap forming the primary winding of a current transformer arranged within said housing, the current transformer electrically connected to an electronic trip unit arranged within said housing, a moveable electrical contact arranged opposite said fixed electrical contact, said movable contact arranged to separate from said fixed contact upon an overcurrent condition; and an operating unit arranged to separate said movable contact from said fixed contact.

5. The circuit breaker of claim 4 wherein said fourth section is angled to said third section.

6. The circuit breaker of claim 4 wherein said fourth section is perpendicular to said third section.

7. A circuit breaker comprising:

a molded case housing;

a cassette arranged within said molded case housing, said cassette having a cut-away portion;

an electrically conductive contact strap arranged within said cassette, wherein said electrically conductive contact strap includes:

a first section including a fixed contact mounted thereon, a U-shaped second section continuous with said first section, a third section continuous with said U-shaped second section, said third section having an aperture, said aperture aligned with said cut-away portion of said cassette and configured to accept connection with a mechanical trip unit external to said cassette, and a fourth section continuous with said third section, said fourth section having an aperture, wherein said aperture in said fourth section is configured to connect with a load strap, the load strap forming the primary winding of a current transformer arranged within said housing, the current transformer electrically connected to an electronic trip unit arranged within said housing, a moveable electrical contact arranged opposite said fixed electrical contact, said movable contact arranged to separate from said fixed contact upon an overcurrent condition; and an operating unit arranged to separate said movable contact from said fixed contact.

8. The circuit breaker of claim 7 wherein said fourth section is angled to said third section.

9. The circuit breaker of claim 7 wherein said fourth section is perpendicular to said third section.

10. A circuit breaker comprising:

a molded case housing;

a cassette arranged within said molded case housing, said cassette having a cut-away portion;

an electrically conductive contact strap arranged within said cassette, wherein said electrically conductive contact strap includes:

a first section including a fixed contact mounted thereon, a U-shaped second section continuous with said first section, a third section continuous with said U-shaped second section, said third section is arranged proximate to said cut-away portion of said cassette, said third section shaped to accept connection with a mechanical trip unit external to said cassette, and a fourth section continuous with said third section, said fourth section shaped to accept connection with a load strap, the load strap forming the primary winding of a current transformer, a current transformer arranged within said housing, the current transformer electrically connected to an electronic trip unit arranged within said housing, a moveable electrical contact arranged opposite said fixed electrical contact, said moveable contact arranged to separate from said fixed contact upon an overcurrent condition; and an operating unit arranged to separate said movable contact from said fixed contact.

11. The circuit breaker of claim 10 wherein said fourth section is angled to said third section.

12. The circuit breaker of claim 10 wherein said fourth section is perpendicular to said third section.

* * * * *